US008801381B2

(12) United States Patent
Simon-Delgado et al.

(10) Patent No.: US 8,801,381 B2
(45) Date of Patent: Aug. 12, 2014

(54) TURBINE BLADE

(75) Inventors: Carlos Simon-Delgado, Baden (CH); Hans-Peter Bossmann, Lauchringen (DE); Herbert Brandl, Waldshut-Tiengen (DE)

(73) Assignee: Alstom Technology Ltd., Baden (CH)

( * ) Notice: Subject to any disclaimer, the term of this patent is extended or adjusted under 35 U.S.C. 154(b) by 838 days.

(21) Appl. No.: 12/877,354

(22) Filed: Sep. 8, 2010

(65) Prior Publication Data

US 2011/0058953 A1 Mar. 10, 2011

(30) Foreign Application Priority Data

Sep. 9, 2009 (EP) ..... 09169858

(51) Int. Cl.
*F01D 5/30* (2006.01)

(52) U.S. Cl.
USPC ..... 416/193 A

(58) Field of Classification Search
USPC ..... 416/193 R, 193 A
See application file for complete search history.

(56) References Cited

U.S. PATENT DOCUMENTS

| | | | | |
|---|---|---|---|---|
| 2,656,146 | A | 10/1953 | Sollinger | |
| 4,019,832 | A | 4/1977 | Salemme et al. | |
| 4,045,149 | A | 8/1977 | Ravenhall | |
| 5,030,063 | A | 7/1991 | Berger | |
| 5,248,240 | A | 9/1993 | Correia | |
| 5,332,360 | A | 7/1994 | Correia et al. | |
| 5,630,700 | A | 5/1997 | Olsen et al. | |
| 5,791,877 | A | 8/1998 | Stenneler | |
| 5,797,725 | A | 8/1998 | Rhodes | |
| 6,331,217 | B1 | 12/2001 | Burke et al. | |
| 6,514,045 | B1 * | 2/2003 | Barton et al. | 416/193 A |
| 6,832,896 | B1 | 12/2004 | Goga et al. | |
| 7,284,958 | B2 | 10/2007 | Dundas et al. | |
| 2002/0127097 | A1 | 9/2002 | Darolia et al. | |
| 2007/0065285 | A1 | 3/2007 | Cairo et al. | |
| 2008/0232969 | A1 | 9/2008 | Brault et al. | |

FOREIGN PATENT DOCUMENTS

| | | | |
|---|---|---|---|
| DE | 10346240 | A1 | 4/2005 |
| EP | 0764765 | A1 | 3/1997 |
| EP | 1306523 | A1 | 5/2003 |
| EP | 1795708 | A2 | 6/2007 |
| EP | 1852572 | A2 | 11/2007 |
| EP | 1905956 | A2 | 4/2008 |
| JP | 52-104611 | A | 9/1977 |
| JP | 55-75507 | A | 6/1980 |
| JP | 59-180006 | A | 10/1984 |
| JP | 59173503 | A | 10/1984 |
| JP | 62041903 | A | 2/1987 |
| JP | 7-150905 | A | 6/1995 |

(Continued)

OTHER PUBLICATIONS

Office Action (Notification of Reasons for Refusal) issued on Apr. 14, 2014, by the Japanese Patent Office in corresponding Japanese Patent Application No. 2010-200685, and an English Translation of the Office Action. (11 pages).

*Primary Examiner* — Dwayne J White
(74) *Attorney, Agent, or Firm* — Buchanan Ingersoll & Rooney PC

(57) ABSTRACT

A turbine blade is provided having an airfoil and a platform manufactured in two separate pieces, which are joined together. The blade includes a seal, which is a mechanically decoupled seal, interposed between the airfoil and platform in a position closer to a hot gases path than a joint.

15 Claims, 5 Drawing Sheets

(56) References Cited

FOREIGN PATENT DOCUMENTS

| | | | |
|---|---|---|---|
| JP | 9-303107 | A | 11/1997 |
| JP | 2002-295202 | A | 10/2002 |
| JP | 2003-148102 | A | 5/2003 |
| JP | 2007-85342 | A | 4/2007 |
| JP | 2007-255224 | A | 10/2007 |
| JP | 2008-232151 | A | 10/2008 |
| JP | 2009-79560 | A | 4/2009 |

* cited by examiner

TURBINE BLADE

FIELD OF INVENTION

The present invention relates to a turbine blade. In particular, the present invention refers to a blade being a guide vane blade or rotor blade of a gas turbine.

BACKGROUND

Blades are known to comprise an airfoil that projects in the hot gases path to guide the hot gases (guide vanes) or exchange mechanical power with the hot gases (rotor blades).

Moreover, blades also comprise platforms that close the space between adjacent airfoils and define a hot gases path.

As the hot gases are very hot (their temperature usually is greater than 1400° C.) the blades are always thermally highly loaded.

Thermal load causes differential deformations between the airfoil and platform that generate large forces that limit the blades service life.

EP 0764765 discloses a blade having an airfoil and a platform made in two separate pieces.

The connection between the airfoil and the platform is realized at their zone facing the hot gases path, i.e. in the same zone where the forces due to the deformations caused by the hot gases temperature are larger.

EP 1306523 discloses blades made of an airfoil and a platform in two separate pieces, but also in this case the connection between the airfoil and the platform is realized in their zone facing the hot gases path, because of the forces that during operation press the platform sides against the blade.

U.S. Pat. No. 5,248,240 discloses a stator vane assembly made of airfoils connected to a platform.

Also in this case the connection is realized in a zone of the airfoil and platform close to the hot gases path.

U.S. Pat. No. 6,331,217 discloses blades made of a plurality of crystal super-alloy pieces joined together across all the surfaces between the pieces.

Also in this case the connection between the pieces (and in particular between the pieces defining the airfoil and those defining the platform) is realized in zones close to the hot gases path.

U.S. Pat. No. 7,284,958 discloses a blade made of an airfoil and a platform at the two opposite sides of the airfoil. The platforms are connected to the airfoil also in its zone close to the hot gases path.

U.S. Pat. No. 2,656,146 discloses a further blade made of a platform having a through hole in which an airfoil is housed. Connection between platform and airfoil is established in the zone of the hole (i.e. close to the hot gases path).

As all the blades according to the prior art are joined (usually brazed but also other means are possible) in zones very close to the hot gases path, i.e. zones where the influence of the temperature of the hot gases flowing through the hot gases path is greater and causes large differential deformations, forces transmitted from the airfoil to platform and vice versa are consequently very large; this impairs the working life of the blades.

SUMMARY

The disclosure is directed to a turbine blade including an airfoil and a platform manufactured in separate pieces joined together at a joint. A mechanically decoupled seal is interposed between the airfoil and the platform in a position closer to a hot gases path than the joint.

BRIEF DESCRIPTION OF THE DRAWINGS

Further characteristics and advantages of the invention will be more apparent from the description of a preferred but non-exclusive embodiment of the blade according to the invention, illustrated by way of non-limiting example in the accompanying drawings, in which.

DETAILED DESCRIPTION OF THE PREFERRED EMBODIMENTS

Introduction to the Embodiments

Figure 1:
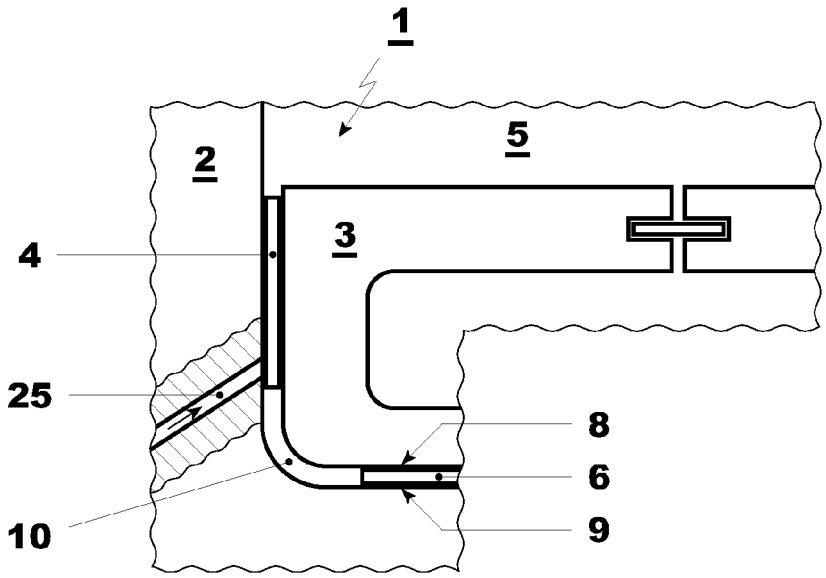
FIG. 1 is a schematic view of a blade of a first embodiment of the invention.

The technical aim of the present invention is therefore to provide a blade (being a rotor blade or a guide vane) by which said problems of the known art are eliminated.

Within the scope of this technical aim, an aspect of the invention is to provide a blade that has the airfoil and the platform connected together but at the same time in which the forces generated by the differential deformations of the airfoil and platform of each blade do not impair the service life of the same blade.

The technical aim, together with these and further aspects, are attained according to the invention by providing a blade in accordance with the accompanying claims.

DETAILED DESCRIPTION

With reference to the figures, shown is a blade 1 of a turbine; in particular the blade 1 can be a guide vane or a rotor blade of a gas turbine.

The blade 1 comprises an airfoil 2 and a platform 3 manufactured in two separate pieces (airfoil and platform) or three separated pieces (airfoil and a platform for each side of the airfoil) that are joined together.

The blade 1 comprises a seal 4 interposed between the airfoil 2 and the platform 3 in a position closer to a hot gases path 5 than a joint 6.

The seal is a mechanically decoupled seal, i.e. it transmits no forces or only marginal forces between the airfoil 2 and the platform 3.

Moreover the seal is preferably oxidation resistant and has high temperature properties.

Advantageously, the seal must provide compliance for relative movement between the airfoil and the platform during operation.

The joint 6 is a permanent joint and in this respect it is preferably a brazing.

As shown in the figures, the joint 6 is realised in portions of the airfoil 2 and platform 3 separated and away from the seal 4 where the deformations of the airfoil 2 and platform 3 are small such that no forces or only marginal forces are transmitted from the airfoil 2 to platform 3 and vice versa.

In a first embodiment, the platform 3 is C-shaped and the joint 6 is realised at the inner portion 8 of the C-shaped platform 3 that faces a corresponding portion 9 of the airfoil 2.

The seal 4 is realised at the regions of the airfoil 2 and platform 3 facing the hot gases path 5 and in particular, it is realised at the central portion of the C-shaped platform 3.

In a further embodiment (FIG. 10), the platform 3 has the shape of an inverted L.

Also in this embodiment the joint 6 is realised in a zone of the airfoil 2 and platform 3 facing one another and the seal 4 is realised at the region of the airfoil 2 and platform 3 facing the hot gases path 5.

In the following particulars embodiments of the invention are in detail described.

FIG. 1 shows a first embodiment of the blade 1 of the invention having the C-shaped platform 3 with a brazing connecting its inner part 8 to a corresponding part 9 of the airfoil 2.

In this embodiment the seal 4 is made of a metallic felt or metallic foam or a brush or leaf connected to the airfoil 2 or platform 3.

In particular in FIG. 1 the seal 4 is shown connected to the airfoil 2 and faces the central part of the C-shaped platform 3.

In addition, FIG. 1 also shows cooling holes 25 that may be provided in the airfoil 2 and/or platform 3 (FIG. 1 shows the cooling holes 25 provided in the airfoil 2).

The cooling holes 25 open in a gap 10 between the airfoil 2 and the platform 3 either in a zone of the gap housing the seal or comprised between the seal 4 and the joint 6.

During operation, the airfoil 2 and the platform 3 deform because of the hot gases passing through the hot gases path 5.

Such deformations are larger in the parts of the airfoil 2 and platform 3 that come directly in contact with the hot gases and the parts close thereto; on the contrary deformations are very limited in the parts of the airfoil 2 and platform 3 that do not come directly in contact with the hot gases and the parts away from the hot gases path 5.

Thus, as the parts of the airfoil 2 and platform 3 closer to the hot gases path 5 are provided with the mechanically decoupled seal 4 that does not transmit any forces (or transmits only marginal forces), there are no forces (or only marginal forces) generated by the differential deformations transmitted from the airfoil 2 to the platform 3 and vice versa.

On the contrary, the zones 8, 9 where the joint 6 is provided are far away from the hot gases path 5 and thus the differential deformations are very limited, this lets the airfoil 2 and platform 3 be connected to each other with no forces or only marginal forces due to the differential deformations be transmitted from the airfoil 2 to the platform 3 and vice versa.

The cooling holes 25 (fed from the compressor of the gas turbine) provide air that, in normal condition (i.e. when the seal 4 is efficient) is blocked by the same seal 4 (in the embodiment shown in FIG. 1 wherein the cooling holes open at the seal 4) or indirectly by the seal 4 and joint 6 that define a closed chamber; thus in normal operating condition (with seal 4 efficient) there is no compressed air waste.

When the seal 4 is damaged, hot gases may enter the gap 10 and further damage the seal, such that sealing is not guaranteed anymore.

In this case, the cooling holes 25 are opened (because the seal 4 has a leakage) such that compressed air starts to pass through the seal 4, preventing the hot gases from entering the gap 10 and reaching the joint 6.

Figure 2:
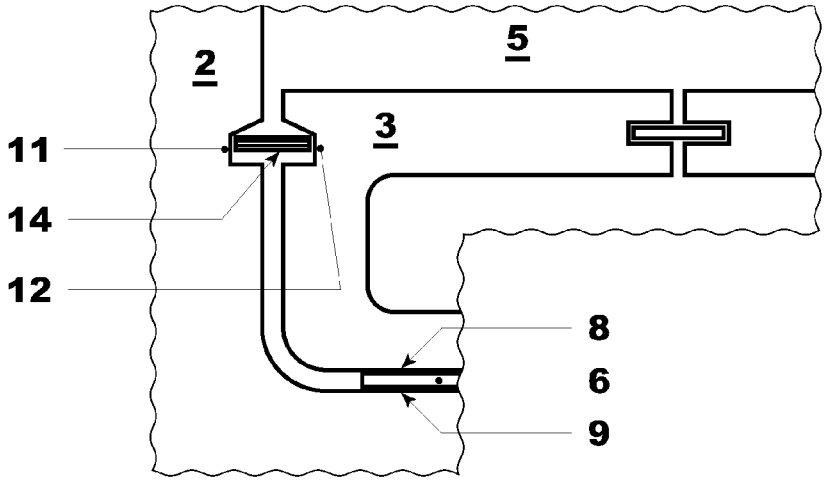
FIG. 2 is another embodiment of the blade of the invention.

FIG. 2 shows an embodiment of the blade 1 similar to that already described and, in this respect, similar elements are indicated by the same references.

The blade 1 of FIG. 2 has recessed seats 11, 12 respectively indented in the airfoil 2 and platform 3 and facing one another.

The seats 11, 12 are flared (in particular the upper walls, i.e. walls closer to the hot gases path 5, are flared).

The seats 11, 12 house a plate 14 made of several layers connected to one another.

These layers have a thickness less than 0.20 millimeters and preferably comprised between 0.09-0.11.

The blade 1 according to this embodiment may define a rotor blade.

In this case, during operation the plate 14 is pressed against the seats 11, 12 by the differential pressure generated by the purge air and centrifugal forces to guarantee the sealing.

In addition, the blade 1 in this embodiment may also be a guide vane.

In this case the plate 14 is pressed against the seats 11, 12 by the differential pressure generated by the purge air to guarantee the sealing.

Figure 3:
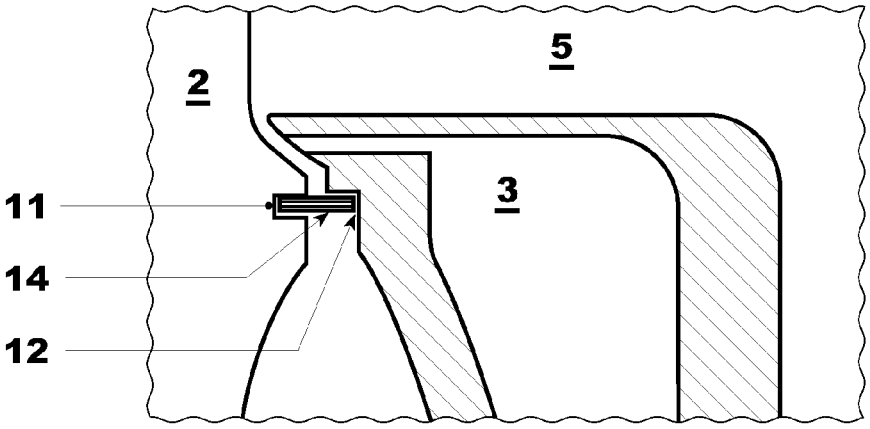
FIGS. 3-10 are further embodiments the blade of the invention.

FIG. 3 shows a further embodiment of a seal made of a plate 14 comprised of a plurality of layers; in this figure, similar elements are indicated by the same references.

In this embodiment the airfoil 2 has a seat 11 that holds the plate 14 and the platform 3 is provided with an open seat 12; naturally the withholding seat may also be provided at the platform 3 and the open seat at the airfoil 2.

During operation, the plate 14 is urged against the seats 11, 12 (to guarantee sealing) by the differential pressure and the centrifugal forces in case the blade 1 is a rotor blade, and by the differential pressure in case the blade 1 is a guide vane.

Figure 4:
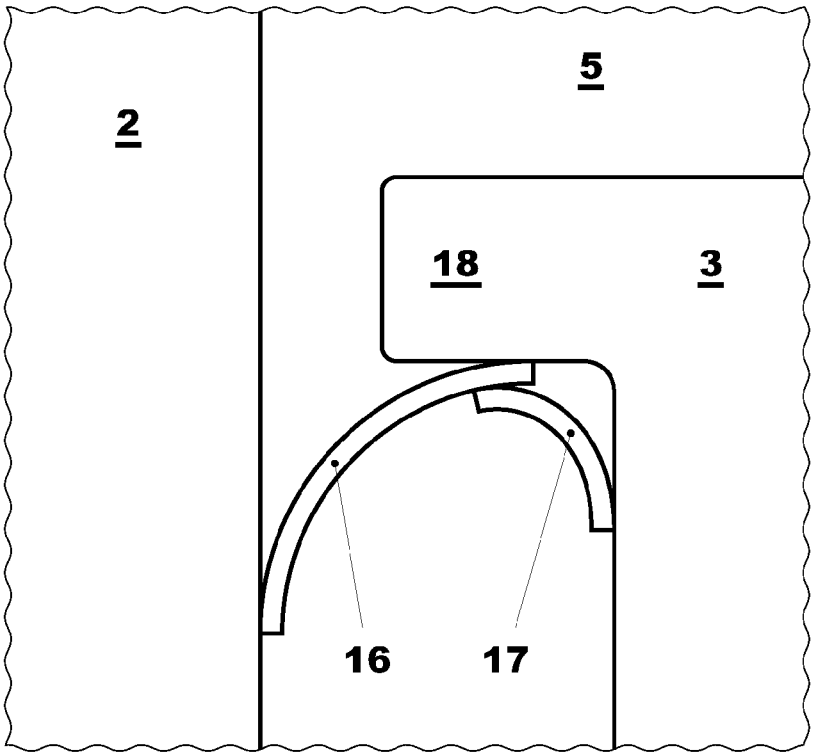
Figure 5:
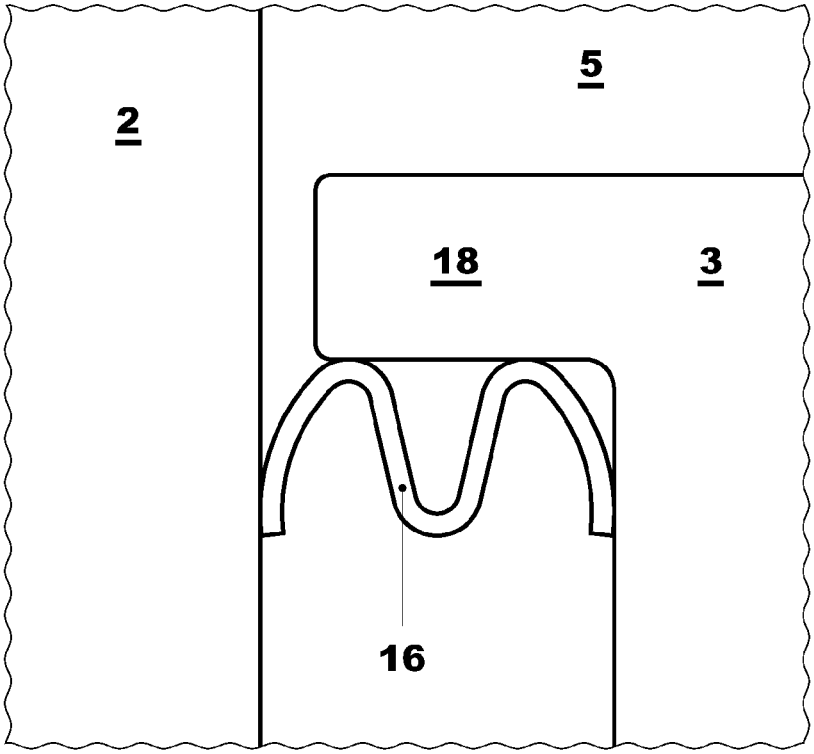

FIGS. 4 and 5 show further embodiments of the blade 1 similar to those already described and, in this respect, similar elements are indicated by the same references.

In these embodiments the seal comprises a spring element connected to the airfoil 2 and/or the platform 3.

In particular, FIG. 4 shows an embodiment with two spring elements 16, 17 one connected to the airfoil 2 and the other to the platform 3.

Moreover, the platform 3 has a projection 18; against this projection 18 the spring element 16 (the one connected to the airfoil 2) rests; the spring element 17 connected to the platform 3 rests against spring element 16.

FIG. 5 shows an embodiment with one single spring element 16 folded twice to define an accordion-like shape and rests against a projection 18 of the platform 3.

This spring element 16 is connected to either the airfoil 2 or the platform 3; nevertheless, the spring 16 may also be connected to both the airfoil 2 and platform 3 (in fact the spring element 16 does not transmit any substantial force to the airfoil 2 or platform 3).

Figure 6:
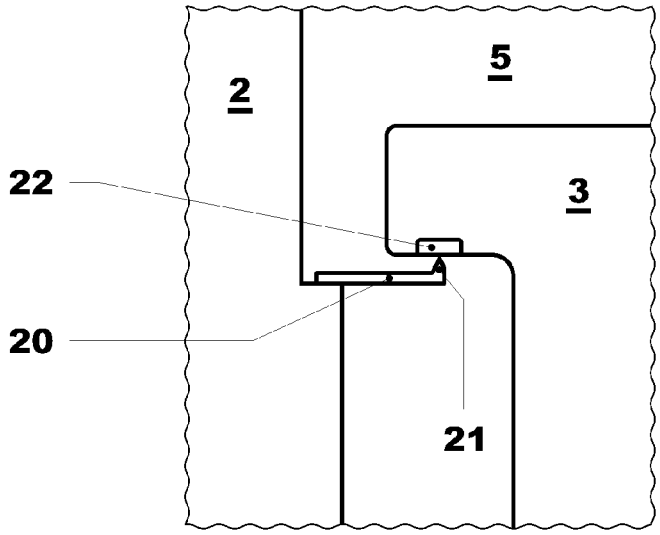

FIG. 6 shows a further seal having a protruding portion 20 from the airfoil 2 or platform 3.

The protruding portion 20 has a knife edge 21 pressed against softer material 22 (such as a metallic felt) of a corresponding portion of the platform 3 or airfoil 2.

Figure 7:
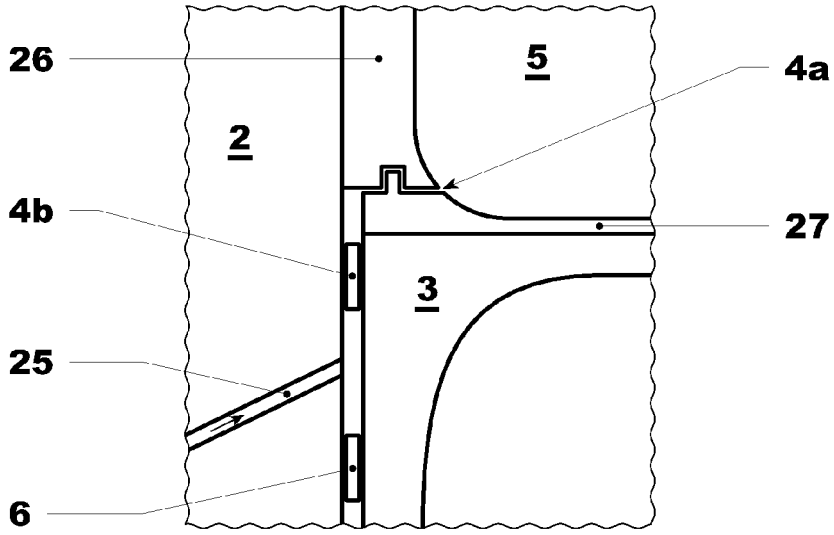

FIG. 7 (the numbers indicate elements similar to those already described) shows an airfoil 2 covered with a protecting coating 26 such as a thermal barrier coating (TBC) or ceramic layer connected to a platform 3 also covered with a protecting coating 27 such as a TBC or ceramic layer.

The coatings 26, 27 define a first seal **4*a* such as a labyrinth seal; moreover, between the airfoil 2 and platform 3 (in a zone close to the labyrinth seal 4*a*) a second seal 4*b* is provided, such as a metallic felt or metallic foam or a brush or leaf connected to the airfoil 2 or platform 3**.

Figure 8:
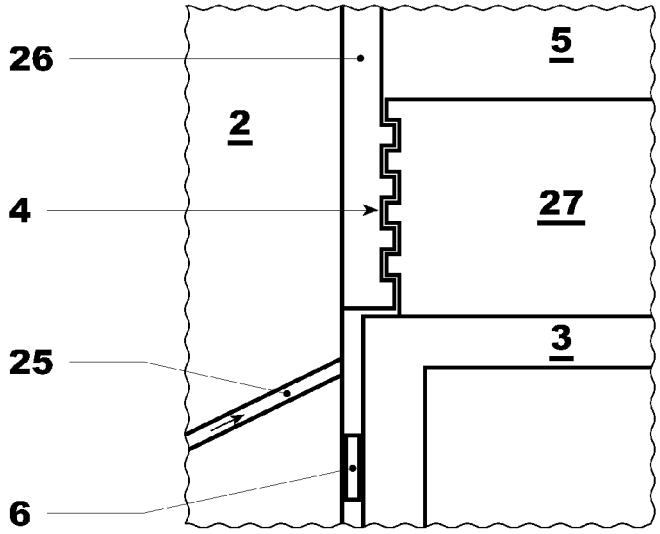

FIG. 8 shows a further embodiment similar to that of FIG. 7; the same numbers indicate equal or similar elements.

In this embodiment the seal 4 is defined by a labyrinth seal (similar to the labyrinth **4*a* of FIG. 7**).

Figure 9:
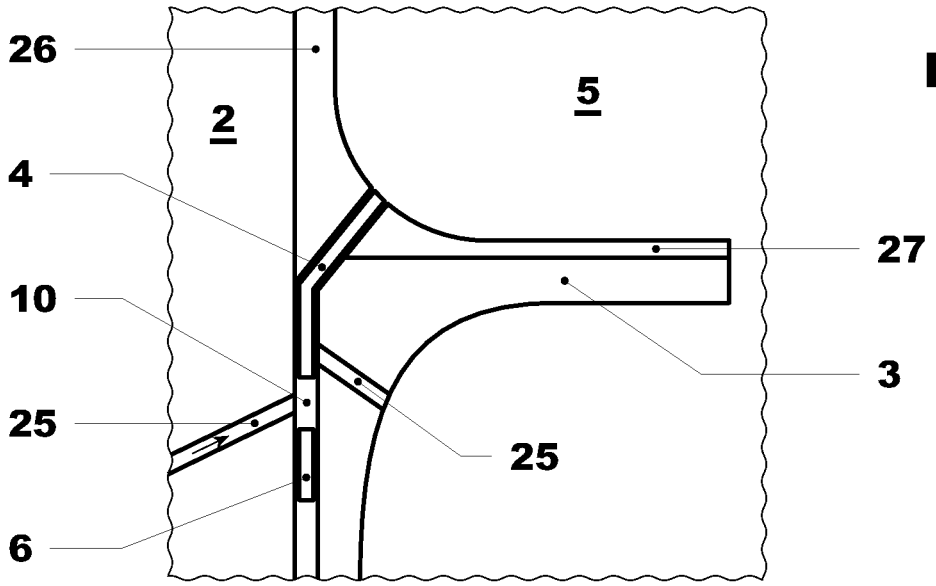

FIG. 9 shows an embodiment similar to that of FIG. 7; in this respect the numbers indicate elements similar to those already described.

The seal 4 is defined by a metallic felt or metallic foam or a brush or leaf provided in the gap 10 between the airfoil 2 or platform 3 and connected to the airfoil 2 or platform 3. Moreover, this seal also extends between the coatings 26 and 27.

Figure 10:
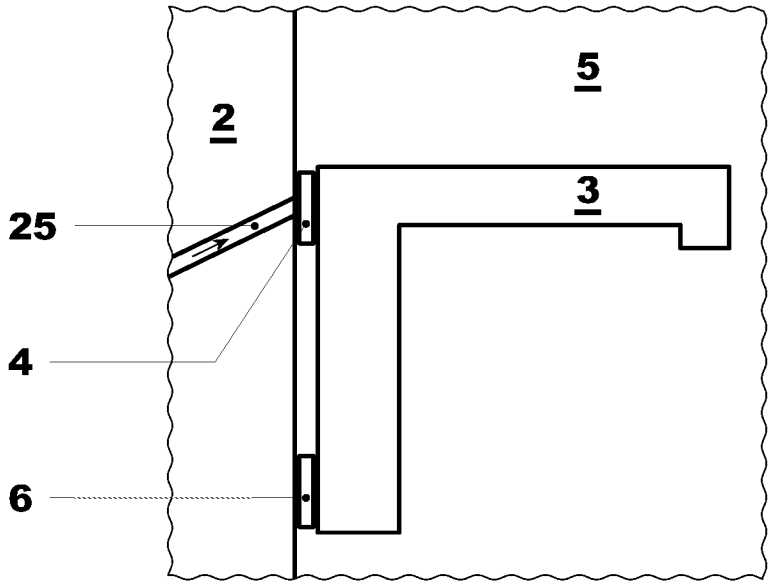
Figure 11:
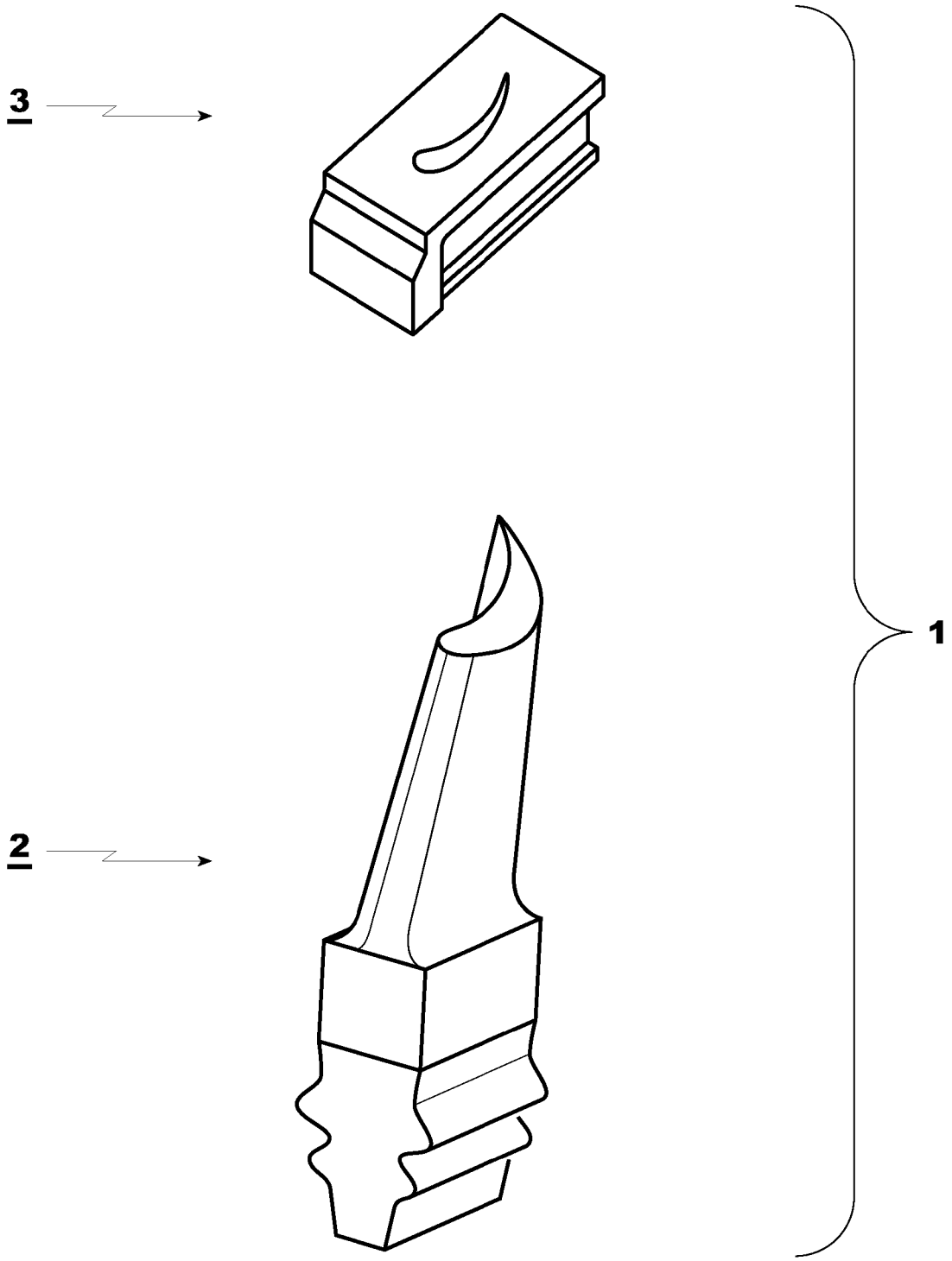
FIG. 11 is a perspective view of an example of a blade according to the invention.

FIG. 10 shows an embodiment similar to that of FIG. 1 (the same references indicate the same or similar elements), but with the platform 3 having an inverted L shape.

Naturally the features described may also be independently provided from one another.

The blade conceived in this manner is susceptible to numerous modifications and variants, all falling within the scope of the inventive concept; moreover all details can be replaced by technically equivalent elements.

In practice the materials used and the dimensions can be chosen at will according to requirements and to the state of the art.

REFERENCE NUMBERS

1 blade (guide vane or rotor blade)
2 airfoil
3 platform
4 seal
4*a* first seal
4*b* second seal
5 hot gases path
6 joint
8 inner portion of the platform
9 portion of the airfoil corresponding to portion 8
10 gap
11, 12 seats
14 plate
16, 17 spring element
18 projection
20 protruding portion
21 knife edge
22 softer material
25 cooling holes
26 protecting coating of 2
27 protecting coating of 3

What is claimed is:

1. A turbine blade, comprising:

an airfoil;

a platform manufactured in separate pieces from the airfoil, the airfoil and the platform being directly connected together at a portion separated from a sealing portion; and a mechanically decoupled seal is interposed between said airfoil and said platform in a position closer to a hot gases path than the portion where the airfoil and the platform are connected, wherein the platform has an inner surface portion, the inner portion being directly connected to a corresponding outer surface portion of the airfoil.

2. The blade as claimed in claim 1, wherein said mechanically decoupled seal transmits no forces or only marginal forces between the airfoil and the platform.

3. The blade as claimed in claim 1, wherein said connection is a permanent joint.

4. The blade as claimed in claim 1, wherein said connection is realized in portions of the airfoil and platform separated from the seal.

5. The blade as claimed in claim 4, wherein said connection is placed in a zone of the airfoil and platform where deformations of the airfoil and platform are less than those in zones that come directly in contact with the hot gases.

6. The blade as claimed in claim 1, wherein said seal is realized at the regions of the airfoil and platform facing the hot gases path.

7. The blade as claimed in claim 1, wherein said seal is made of a metallic felt or metallic foam or a brush or leaf connected to the airfoil or platform.

8. The blade as claimed in claim 7, wherein said airfoil and/or platform comprise cooling holes that open in a gap between the airfoil and the platform in a zone of the gap housing the seal or between the seat and the connection.

9. A turbine blade comprising an airfoil and a platform manufactured in separate pieces joined together at a joint, wherein a mechanically decoupled seal is interposed between said airfoil and said platform in a position closer to a hot gases path than the joint, wherein said seal comprises recessed seats indented in the airfoil and platform and facing one another, said seats housing a plate made of several layers connected to one another.

10. The blade as claimed in claim 1, wherein said seal comprises at least a spring element connected to the airfoil and/or platform.

11. The blade as claimed in claim 10, wherein said seal comprises two spring elements, one connected to the airfoil and the other connected to the platform.

12. A turbine blade comprising an airfoil and a platform manufactured in separate pieces joined together at a joint, wherein a mechanically decoupled seal is interposed between said airfoil and said platform in a position closer to a hot gases path than the joint, wherein said seal has a protruding portion from the airfoil or platform having a knife edge that presses against a softer material of a corresponding portion of the platform or airfoil.

13. The blade as claimed in claim 12, wherein said softer material is a metal felt.

14. A turbine blade comprising an airfoil and a platform manufactured in separate pieces joined together at a joint, wherein a mechanically decoupled seal is interposed between said airfoil and said platform in a position closer to a hot gases path than the joint, wherein said seal comprises a labyrinth seal.

15. The blade as claimed in claim 1, wherein the blade is a guide vane or a rotor blade of a gas turbine.

* * * * *